US009617961B2

(12) United States Patent
Harvey et al.

(10) Patent No.: US 9,617,961 B2
(45) Date of Patent: Apr. 11, 2017

(54) ANTI-ROTATION CLIP FOR A TWIST LOCK FUEL INJECTION

(71) Applicant: Hitachi Automotive Systems Americas Inc., Harrodsburg, KY (US)

(72) Inventors: William T. Harvey, Brighton, MI (US); Steven J. Miller, Livonia, MI (US); Hiroaki Saeki, West Bloomfield, MI (US)

(73) Assignee: HITACHI AUTOMOTIVE SYSTEMS AMERICAS, INC., Harrodsburg, KY (US)

( * ) Notice: Subject to any disclaimer, the term of this patent is extended or adjusted under 35 U.S.C. 154(b) by 0 days.

(21) Appl. No.: 14/337,308

(22) Filed: Jul. 22, 2014

(65) Prior Publication Data

US 2014/0353408 A1 Dec. 4, 2014

Related U.S. Application Data

(63) Continuation of application No. 12/852,905, filed on Aug. 9, 2010, now Pat. No. 8,813,722.

(51) Int. Cl.
*F02M 69/46* (2006.01)
*F02M 55/00* (2006.01)

(52) U.S. Cl.
CPC ..... *F02M 55/005* (2013.01); *F02M 69/465* (2013.01); *F02M 2200/852* (2013.01); *F02M 2200/853* (2013.01); *Y10T 29/53* (2015.01)

(58) Field of Classification Search
CPC ..... F02M 55/005; F02M 2200/853; F02M 2200/852; F02M 2200/856; F02M 69/465; Y10T 29/53
(Continued)

(56) References Cited

U.S. PATENT DOCUMENTS 5,035,224 A 7/1991 Hornby et al.
5,964,483 A * 10/1999 Long ..... F16L 37/144 285/305
(Continued)

OTHER PUBLICATIONS

GM High Feature engine—http://en.wikipedia.org/wiki/GM_High_Feature_engine.com.
(Continued)

*Primary Examiner* — Arthur O Hall
*Assistant Examiner* — Juan C Barrera
(74) *Attorney, Agent, or Firm* — Mattingly & Malur, PC

(57) ABSTRACT

A fuel injector for an internal combustion engine having an elongated body with a fuel inlet end and a fuel discharge end. The injector body includes an outwardly extending plate attached at a position between its ends and this plate includes at least one radially outwardly extending tab so that the cross-sectional shape of the plate is noncircular. A fuel cup receives the fuel inlet end of the fuel injector and includes a radially inwardly extending ledge at a mid position of the cavity. This ledge includes a through bore complementary in shape to the shape of the plate so that, with the fuel injector and plate aligned at a predetermined angular assembly position, the plate passes through the ledge upon insertion of the fuel injector into the cavity. Thereafter, rotation of the fuel injector and attached plate to a locking position positions the tabs above the ledge thus locking the fuel injector to the fuel cup.

1 Claim, 4 Drawing Sheets

(58) Field of Classification Search
USPC ..... 239/600, 533.2; 123/470, 456; 285/369, 285/305
See application file for complete search history.

(56) References Cited

U.S. PATENT DOCUMENTS

| | | | | |
|---|---|---|---|---|
| 6,019,089 | A * | 2/2000 | Taylor et al. | 123/470 |
| 6,457,456 | B1 | 10/2002 | Scollard et al. | |
| 7,467,618 | B2 | 12/2008 | Zdroik et al. | |
| 7,556,022 | B1 * | 7/2009 | Doherty | F02M 55/004 123/456 |
| 7,581,530 | B2 | 9/2009 | Scheffel et al. | |
| 7,802,559 | B2 | 9/2010 | Furst et al. | |
| 7,856,962 | B2 | 12/2010 | Harvey et al. | |
| 8,813,722 | B2 * | 8/2014 | Harvey et al. | 123/470 |
| 2007/0175450 | A1 | 8/2007 | Eckbauer et al. | |
| 2010/0012093 | A1 * | 1/2010 | Pepperine et al. | 123/470 |

OTHER PUBLICATIONS

GM Family II engine—http://en.wikipedia.org/wiki/GM_Family_II_engine.com.

* cited by examiner

ANTI-ROTATION CLIP FOR A TWIST LOCK FUEL INJECTION

CROSS-REFERENCE TO RELATED APPLICATIONS

This application is a continuation of U.S. patent application Ser. No. 12/852,905 filed Aug. 9, 2010, the contents of which are incorporated herein by reference.

BACKGROUND OF THE INVENTION

I. Field of the Invention

The present invention relates generally to a fuel injector assembly for internal combustion engines.

II. Description of Related Art

Many modern internal combustion engines of the type used in automotive vehicles utilize fuel injectors for injecting fuel into the internal combustion chambers. For example, in a direct injection internal combustion engine, a discharge end of the fuel injector is open directly to the internal combustion chamber.

In order to overcome the high pressures present within the internal combustion engine and still obtain adequate injection of the fuel for direct injection engines, these previously known fuel injection systems typically included a fuel rail which is pressurized with relatively high pressure fuel. A fuel cup was then fluidly connected to the fuel rail for each fuel injector.

An elongated fuel injector is associated with each cup and each fuel injector includes a fuel inlet end as well as a fuel outlet end. The fuel inlet end is axially inserted into a cavity in its associated fuel cup and the fuel injector and cup are then locked together. Conventionally, a locking clip was utilized to lock the fuel cup and its associated fuel injector together.

These previously known fuel clips, however, have not proven wholly satisfactory in operation. In particular, these previously known injector clips are not only relatively expensive in material, labor, and manufacturing costs, but may also permit the fuel injector to separate from its associated fuel cup if improperly installed. Such separation can result in failure of the entire fuel system.

SUMMARY OF THE PRESENT INVENTION

The present invention provides a fuel injector assembly which overcomes the above-mentioned disadvantages of the previously known systems.

In brief, in the present invention a fuel injector includes an elongated body with a fuel inlet end and a fuel discharge end. The fuel injector is preferably used in a direct injection internal combustion engine, although other types of engines may alternatively be used.

A radially outwardly extending plate is either attached to or formed as a part of the fuel injector so that the plate protrudes radially outwardly from the main body of the fuel injector at a position between its fuel inlet and fuel discharge end. The plate, furthermore, is affixed to the fuel injector body so that the plate and the fuel injector body rotate in unison with each other.

The fuel injector assembly further includes a fuel cup having a cavity open at one end and its other end adapted for connection with a pressurized fuel rail. An inner end of the cavity forms a fuel inlet chamber and this chamber is fluidly connected by a fluid port extending through the cup into the fuel rail.

The plate includes at least one, and preferably two or more radially outwardly extended tabs. Consequently, the cross-sectional shape of the plate is noncircular.

An annular ledge extends radially inwardly into the fuel cup cavity and the ledge and the fuel cup are preferably of a one piece construction. Cutouts are formed in the ledge so that the ledge is complementary in shape to the shape of the fuel injector plate. Consequently, the plate is only capable of passing through the ledge at one or more predefined angular positions of the fuel injector relative to the cup.

In order to assemble the fuel injector to the fuel cup, the fuel injector is rotated to the predetermined angular assembly position so that the tabs on the plate register with the corresponding like shaped cutouts in the ledge. Insertion of the fuel inlet end of the fuel injector into the cup cavity not only causes the fuel inlet end of the injector to be positioned within the fuel inlet chamber, but also inserts the plate through the ledge and positions the injector plate above or on the inside end of the cup ledge. Subsequent rotation of the fuel injector with its attached plate thus causes the plate to be positioned between the ledge and the fuel inlet end of the cup and the tabs on top of the ledge thus locking the injector end and cup together.

In order to prevent unintended subsequent separation of the fuel injector from its associated fuel cup, a locking pin extending through the cup body abuts against the plate or other portion of the fuel injector and prevents the fuel injector from rotating back to its insertion position. This, in turn, prevents the plate from again sliding out through the ledge openings and away from the fuel cup.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
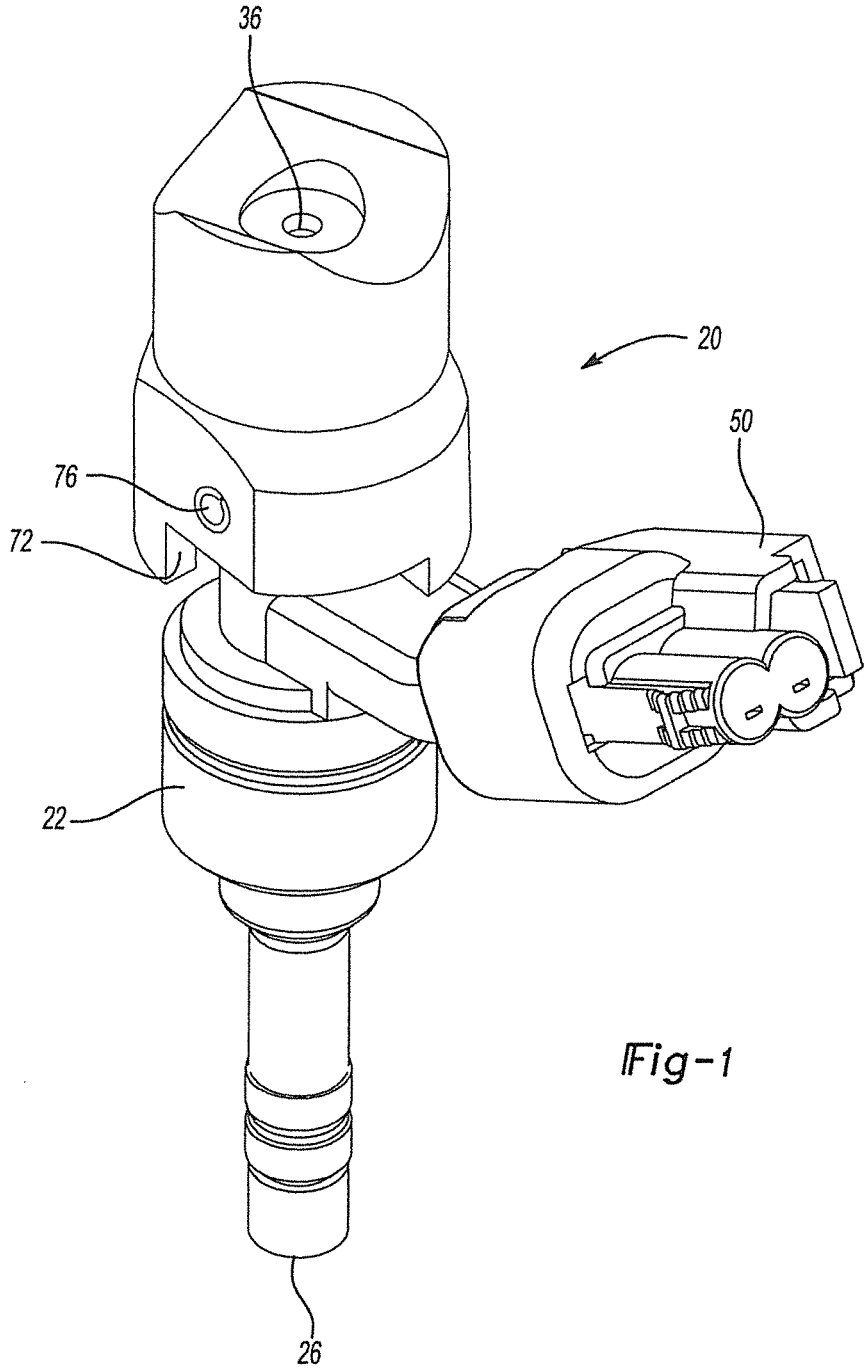
FIG. 1 is an elevational view of a preferred embodiment of the fuel injector of the present invention.
Figure 2:
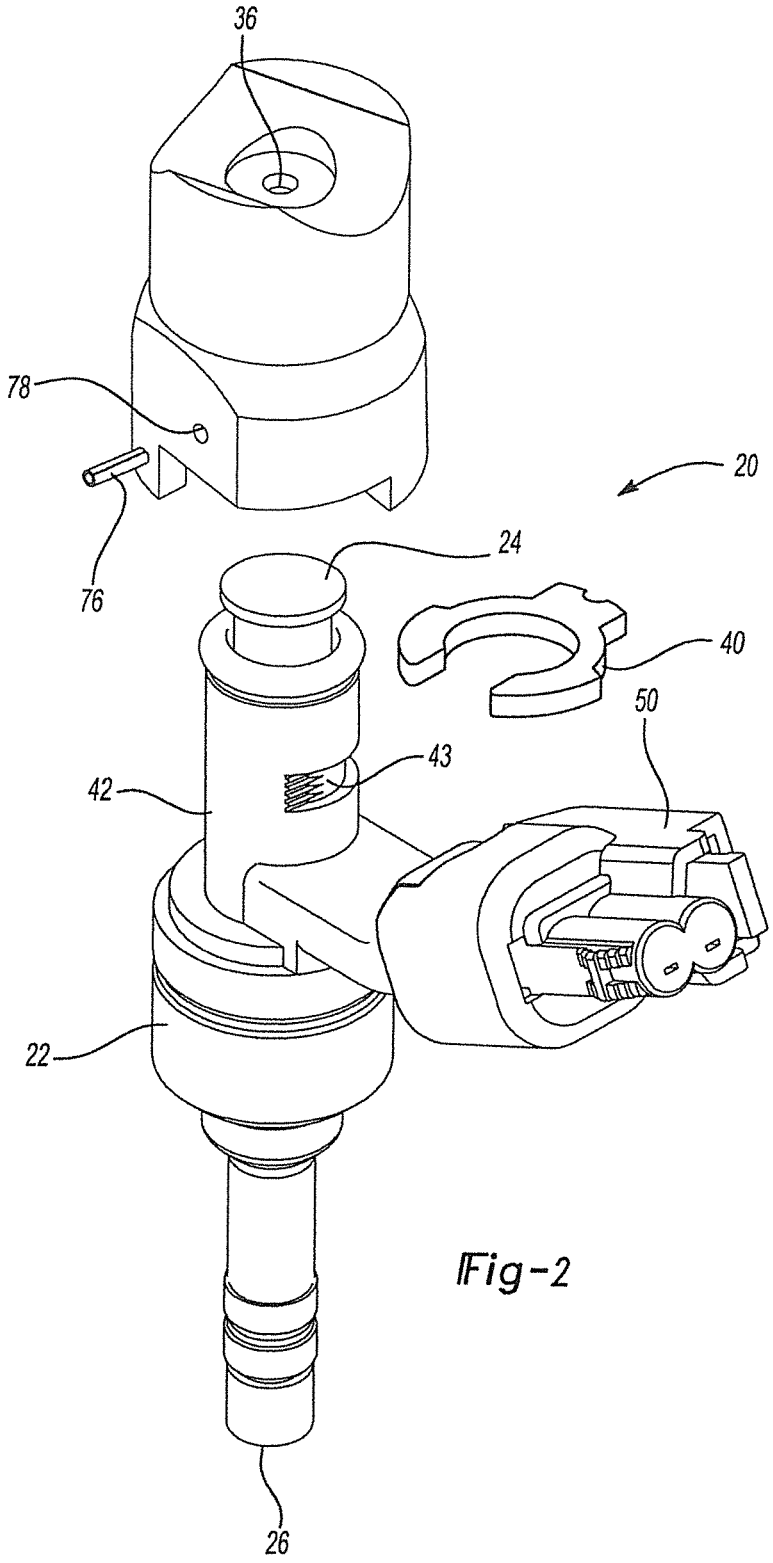
FIG. 2 is an exploded elevational view thereof.

With reference first to FIGS. 1 and 2, a fuel injector assembly 20 is shown. The fuel injector assembly 20 is of the type generally used in direct injection internal combustion engines.

The fuel injector assembly 20 includes an elongated fuel injector 22 having a fuel inlet end 24 and a fuel discharge end 26. A fuel inlet extends between the inlet chamber and an exterior of the fuel cup. The fuel discharge end 26 is adapted to be open to a chamber of an internal combustion engine so that fuel from the injector 22 is injected directly into the combustion chamber (not shown).

Figure 3:
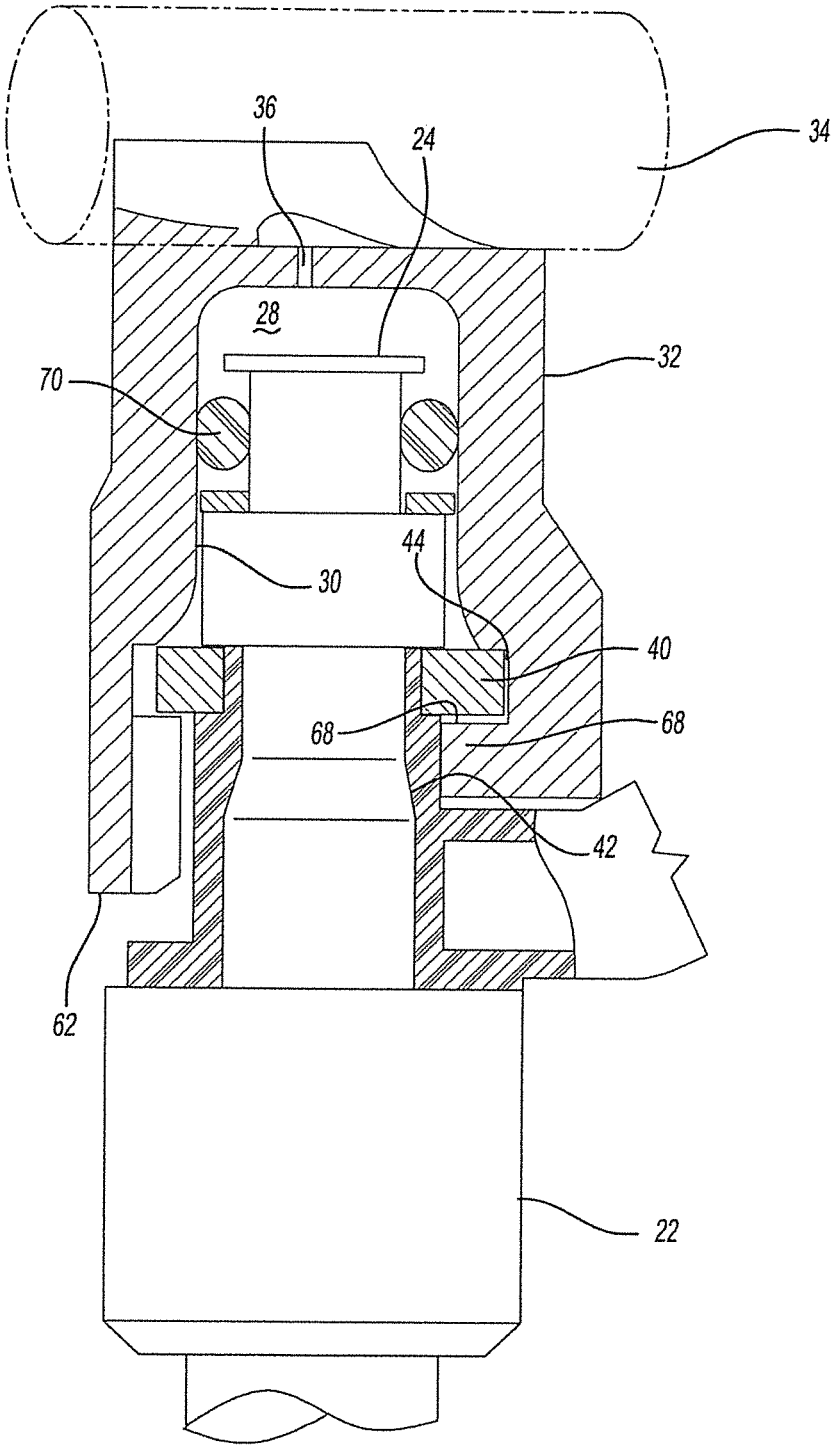
FIG. 3 is a partial longitudinal sectional view thereof.

Referring to FIGS. 2 and 3, the fuel inlet end 24 of the fuel injector 22 is positioned within a fuel inlet chamber 28 formed at an inner end of a cavity 30 in a fuel cup 32. The fuel cup 32 is adapted for connection with a fuel rail 34 and the interior of the fuel rail 34 is fluidly connected to the fuel chamber 28 by a fuel port 36 in the fuel cup 32.

An electrical connector 50 extends laterally outwardly from the fuel injector body 42. In a conventional fashion, electric signals are sent to the connector 50 to open and close the fuel injector 22.

With reference now to FIGS. 2 and 3, a plate 40 is attached to and extends radially outwardly from a main body 42 of the fuel injector 22 at a point intermediate its ends. This plate 40, furthermore, may be a separate piece which is attached to the injector body 42 or of a one piece construction with the main body 42. If the plate 40 is separate, as shown in FIG. 2, the plate engages a slot 43 which locks the plate 40 to the main body 42 at a predetermined angular position relative to the injector body 42.

Figure 4:
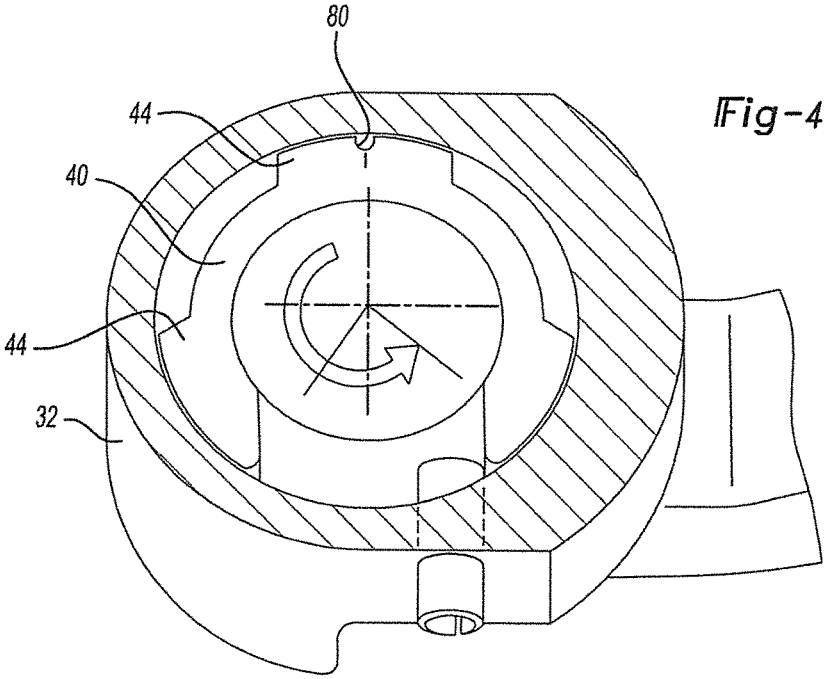
FIGS. 4-6 are bottom partial sectional views taken above the plate illustrating the insertion and locking of the fuel injector body to the fuel cup.
Figure 5:
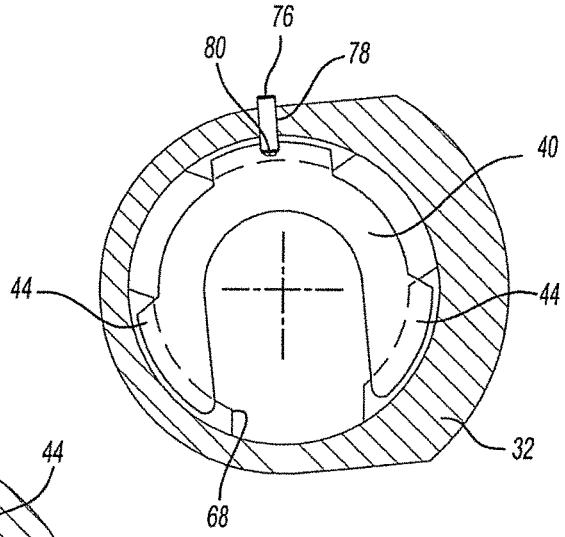
Figure 6:
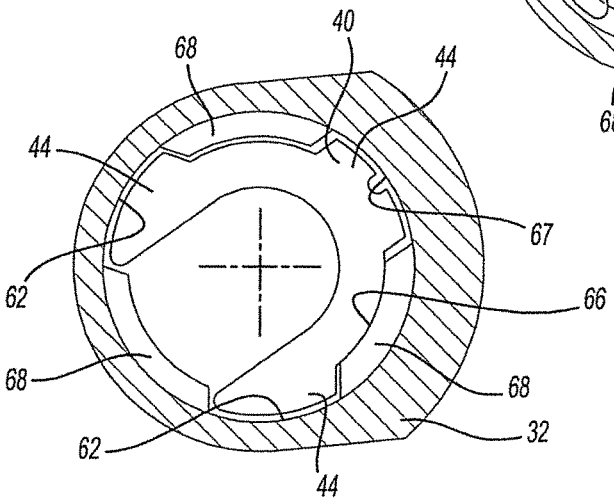

As best shown in FIGS. 4-6, the plate 40 includes at least one, and preferably two or more radially outwardly extending tabs 44 relative to the longitudinal axis of the fuel injector 22. Consequently, the cross-sectional shape of the plate 40 is noncircular.

As best shown in FIGS. 3-6, a ledge 60 extends radially inwardly into the cup cavity 30 adjacent a lower end 62 of the fuel cup 32 opposite from the fuel chamber 28. Preferably, the ledge 60 and the fuel cup 32 are of a one piece construction.

As best shown in FIG. 6, the ledge 60 includes a noncircular through opening 66 with cutouts 67 which is not only complementary in shape to the shape of the injector plate 40, but also substantially the same size, or slightly greater in area, than the cross-sectional area of the injector plate 40. Thus, in order to assemble the fuel injector 22 to the fuel cup 32, the fuel inlet end 24 of the fuel injector is inserted into the fuel cup cavity 30 through the lower end 62 of the fuel cup so that the fuel inlet end 24 of the fuel injector 22 faces the fuel chamber 28.

The fuel injector 22 is then rotated until the fuel injector plate 40 is aligned with the through opening 66 as shown in FIG. 6. Such an alignment only occurs at one or more predefined angular positions of the fuel injector 22 relative to the fuel cup 32. However, when the plate 40 is aligned with the ledge opening 66, the plate 40 is able to pass through the ledge 60 until the plate 40 is positioned in between the ledge 60 and the fuel chamber 28 as shown in FIG. 3. Rotation of the fuel injector 22 with its attached plate 40 to an angular offset position from the aligned position as shown in FIGS. 3 and 5 causes the plate tabs 44 to be positioned over an inner side 68 (FIG. 3) of the fuel cup ledge 60 thereby locking the fuel injector 22 and fuel cup 32 together.

When the fuel injector 22 is inserted to its assembled position illustrated in FIG. 3, the fuel inlet end 24 of the fuel injector 22 is positioned within the fuel chamber 28. Simultaneously, an annular seal 70 carried by the fuel injector main body 42 sealingly engages the inside of the fuel chamber 28 thus preventing leakage of fuel from the fuel chamber 28 around the fuel injector 22.

Similarly, when the fuel injector 22 is moved to its assembled position illustrated in FIG. 1, a portion of the electrical connector 50 is positioned within a cutout recess 72 at the lower end 62 of the fuel cup 32. This recess 72 not only provides a more compact construction of the overall fuel injector assembly 20, but also provides a reference for rotating the fuel injector 22 between its assembly or insertion position (FIG. 6) and its locked position (FIG. 5). For example, in order to assemble the fuel injector 22 to the fuel cup 32 by inserting the plate 40 through the ledge 60, the electrical connector 50 is aligned with one end of the cutout 72. After insertion of the plate 40 past the fuel cup ledge 60 and rotation to the other side of the cutout 72, a visual indication is created of the locking position for the injector 22 to the fuel cup 32.

As shown in FIG. 5, in order to prevent the unattended detachment of the fuel injector 22 from the fuel cup 32, once the fuel injector 22 is rotated to its locked position, a retainer 76, such as a roll pin, is press fit through an opening 78 (FIG. 2) in the fuel cup 32. Upon full insertion of the retainer 76, an inner end of the retainer 76 is positioned within a notch 80 in the plate 40. Consequently, the mechanical interference between the inner end of the retainer 76 and the plate notch 80 will prevent the rotation of the fuel injector 22 back to its assembly or insertion position in which the tabs 44 on the plate 40 are aligned with their like shaped openings in the ledge through opening 66.

From the foregoing, it can be seen that the present invention provides a simple and yet highly effective fuel injector assembly. Having described our invention, however, many modifications thereto will become apparent to those skilled in the art to which it pertains without deviation from the spirit of the invention as defined by the scope of the appended claims.

We claim:

1. A fuel injector assembly comprising:

a fuel cup defining a cavity open at one end and having an inwardly protruding ledge at a mid-point of said cavity, an elongated fuel injector having an inlet end and a discharge end, said inlet end being insertable into said fuel cup cavity, a plate attached to said fuel injector adjacent to said inlet and said plate insertable through said open end of said fuel cup and past said ledge only when said plate is at a predetermined rotational position relative to said fuel cup, said fuel cup and said fuel injector both having cooperating surfaces which lock said fuel cup and said fuel injector together only at one or more predetermined rotational positions of said fuel injector relative to said fuel cup, wherein said fuel cup includes an opening extending between said cavity and exteriorly of said fuel cup, said fuel cup opening being completely surrounded by said fuel cup, and a pin insertable through said opening so that a portion of said pin protrudes into said cavity and cooperates with said fuel injector to limit rotation of said plate from a position other than said predetermined position.

* * * * *